United States Patent [19]

Corte

[11] 4,053,041

[45] Oct. 11, 1977

[54] LABELING DEVICE

[76] Inventor: Francisco Barcelloni Corte, Corrientes 2021, Buenos Aires, Argentina

[21] Appl. No.: 611,007

[22] Filed: Sept. 8, 1975

[30] Foreign Application Priority Data

Sept. 10, 1974 Argentina ..... 255536

[51] Int. Cl.[2] ..... B41J 1/30

[52] U.S. Cl. ..... 197/6.7; 101/18

[58] Field of Search ..... 197/6.7; 101/18; 226/157, 168

[56] References Cited

U.S. PATENT DOCUMENTS

| | | | |
|---|---|---|---|
| 3,307,674 | 3/1967 | Massen et al. | 197/6.7 |
| 3,319,756 | 5/1967 | Pelikan | 197/6.7 |
| 3,664,477 | 5/1972 | Bermer | 197/6.7 |
| 3,774,744 | 11/1973 | Corte | 197/6.7 |
| 3,818,773 | 6/1974 | Natori | 197/133 R |
| 3,820,645 | 6/1974 | Davis | 197/6.7 |

OTHER PUBLICATIONS

J H Massey, "Selectively Controllable Document Feed Device" IBM Technical Disclosure Bulletin, vol. 8, No. 11, p. 1636 4/66.

*Primary Examiner*—Edgar S. Burr
*Assistant Examiner*—William Pieprz
*Attorney, Agent, or Firm*—Allegretti, Newitt, Witcoff & McAndrews

[57] ABSTRACT

A labeling device which includes a pair of spaced printing element carrying, rotatable wheels for imprinting characters on a tape. A path of travel for the tape is defined between the wheels and a mechanism is provided for feeding the tape along the path of travel. A mechanism is provided for applying pressure to the deformable arms for causing the desired imprinting of characters. A lever is pivotally mounted for operating the tape feeding mechanism and the pressure applying mechanism. An arm is mounted on and extends from the lever and the arm includes an end portion which is remote from the mounting position thereof on the lever. A guide element is carried on the end portion. A closed track, having an initial portion and a later portion, is provided in the body of the labeling device and is constructed and arranged to receive and guide the guide element therein. The tape feeding mechanism includes a sprocket wheel which drivably engages the tape. Teeth are carried on the end portion of the arm for drivably moving the sprocket wheel as the guide element is moved in the initial portion only of the track, in response to the pivoting movement of the lever. A member is carried on the lever for operatively engaging the pressure applying mechanism for imprinting a desired character on the tape as the guide element is moved in the later section only of the track, in response to continued pivoting movement of the lever.

2 Claims, 6 Drawing Figures

LABELING DEVICE

BACKGROUND OF THE INVENTION-FIELD OF THE INVENTION AND DESCRIPTION OF THE PRIOR ART

The present invention relates to a labeling device, and it particularly relates to a manually operated labeling device that provides substantial advantages with respect to similar devices presently used.

Different types of tape labeling devices are well known, the common characteristic of which is the fact that they have a head, provided with a wheel, in which the printing types are distributed, that form, in the lower surface thereof, depressions of the types which match identical projecting types formed on the ends of the elastically deformed arms of a second wheel, which is positioned below the first wheel; the passage way for the tape to be printed is defined between the two wheels. The arms are forced toward the printing position by a printing hammer or punch that responds to the operation of a pulsator or operating lever. The pulsator lever operates in cooperation with a tape feeding mechanism.

These labeling devices require a perfectly coordinated operation between the feed mechanism and the printing mechanism, as any displacement therebetween may cause superimposed printing or an irregular spacing between the printed types.

In larger labeling devices, in order to insure this coordination the mechanisms used are commonly complex, the complexity being required by the need to have a larger number of displaceable pieces, complicating the relationship with the operating lever.

For the purpose of simplifying such mechanisms, labeling devices have been made wherein the return spring for the operating lever simultaneously constitutes the operating means for the feed sprocket for moving the tape to be labeled. Such a system, relying in the elasticity of the return spring, has not fully solved the problem of slipping of the tape feed mechanism, with the resulting difficulties mentioned above.

In each case, the tape feeding mechanism has a sprocket solidary or unitary with the advancing sprocket for the tape. Either the return spring of the lever (in some of the so-called "pocket" or "mini" labeling devices, wherein it was desired to simplify the device without taking into consideration other difficulties, such as sliding) or an angularly displaceable element which makes the sprocket advance at a predetermined angle operates on the sprocket. The sprocket that operates as a ratchet wheel, however, must have an accessory means capable of preventing its return when the action of the driving means ceases.

Prior labeling devices are shown, for example, in my U.S. Pat. No. 3,704,771, issued Dec. 5, 1974, and in my U.S. Pat. No. 3,774,774, issued Nov. 27, 1973.

SUMMARY OF THE INVENTION

In order to overcome the mentioned disadvantages of certain prior labeling devices, my invention is based on a completely different concept from that of the known labeling devices, both as to the tape feed mechanism and as to the operation of the hammer or punch that accomplishes printing on the tape; although both mechanisms respond to a single control, compressing a manual pulsator lever, the operating spring is used only for the return the lever and the spring is completely independent from the feed mechanism itself.

Another important feature of the invention is accomplished by the fact that the sprocket of the tape feed mechanism is an ordinary gear wheel that does not require ratchet means, as the gearing is only utilized in the feeding run of the mechanism and, once the gearing has been operated and returned, the driving or operating means thereof is displaced from the connection and is locked in an inoperative position.

Another feature of my invention is the fact that the printing and feeding mechanisms, although both are connected to the operating lever, are independent from each other, thereby permitting an easier and better synchronization therebetween, as both respond to the angular displacement of the lever.

Also, the concept of my device provides a more compact device than conventional devices, providing a substantially flat shape. This is due to the fact that the mechanisms, particularly the printing mechanisms, have control means for the printing hammer or punch displacement arranged with a transverse displacement, operating like a wedge in an inclined plan.

Also, the operation of the tape feeding mechanism in my device is improved as its operation is displaceably guided in a closed path of travel which defines a run corresponding to the tape feeding stage, the displacement corresponding to the printing stage and the return to the initial rest position, the latter being effected with the tape driving means laterally displaced relative to the feeding wheel.

My invention broadly comprises a labeling device of the type that includes a body, a pair of spaced wheels rotatably mounted in the body, a path of travel being defined between the wheels, through which tape to be imprinted is passed, means for feeding the tape along the path of travel, one of the wheels including a plurality of elastically deformable arms, each of the arms carrying a printing element for cooperating with a corresponding element carried on the other of said wheels for imprinting a desired character on the tape, a lever pivotally mounted on the body for operating the tape feeding means and the pressure applying means, biasing means for returning the lever to an inoperative position, an arm mounted on and extending from the lever, an end portion on the arm remote from the mounting position thereof on the lever, a guide element carried on the end portion, a closed track in the body having an initial portion and a later portion, the track being constructed and arranged to guide the guide element therein, the tape feeding means including a sprocket wheel which drivable engages the tape, means carried on the end portion of the arm for drivably moving said sprocket wheel as the guide element is moved in the initial portion only of said track, in response to pivotal movement of the lever, and means carried on the lever for operatively engaging the pressure applying means for imprinting a desired character on the tape as the guide element is moved in the later section only of the track, in response to continued pivoting movement of the lever.

Further purposes and objects of my invention will appear as the specification proceeds.

BRIEF DESCRIPTION OF THE DRAWINGS

A particular embodiment of the present invention is illustrated in the accompanying drawings, wherein.

DETAILED DESCRIPTION OF THE PREFERRED EMBODIMENT

Figure 1:
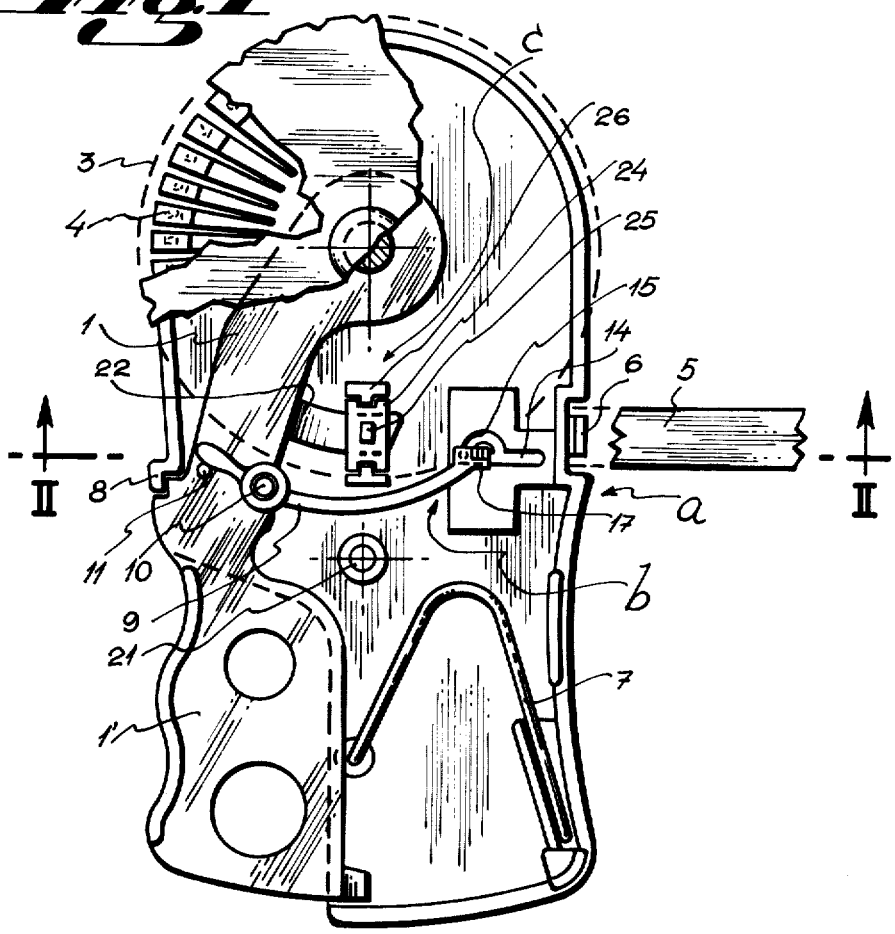
FIG. 1 is a plan view of the labeling device, partially shown in cross section, in a rest or inoperative position, the pulsator lever with its return spring and, independent therefrom, the operating means for the tape feeding mechanism and the printing hammer or punch also being shown.
Figure 2:
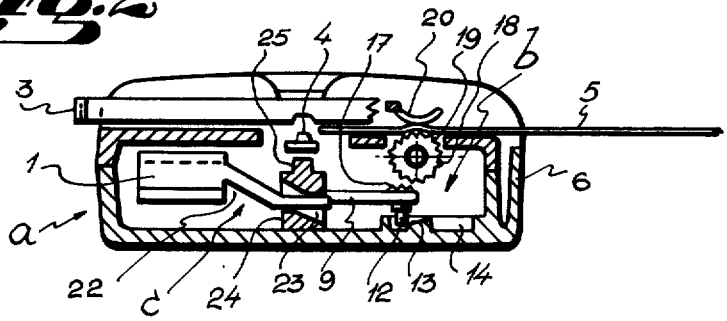
FIG. 2 is a cross sectional view through the line II—II of FIG. 1, showing a section corresponding to the operative run of the assembly, in profile, as well as the operating portion of the printing hammer.

As seen in the drawings, the labeling device of my invention includes a lever cover *a*, substantially flat in shape. A laterally projecting portion 1' of the pulsator lever 1 projects from the cover *a* and preferably pivots around the upright axle 2 of the upper and lower printing wheels 3 and 4, that form the printing assembly between which the tape 5 to be printed advances (FIGS. 1, 2, 4 and 6). The displacement of the lever 1 is independent, of the rotation of the axle 2 for the selection of the sign or type to be printed.

On the edge of the cover *a*, connected to the entrance path of the tape 5, there is a lug 6, in the shape of a hook, on which a carrying cartridge (not illustrated) for the tape may be placed.

The manually operated projecting portion 1' of the lever 1 is moved to the inoperative, resting position by means of a return spring 7, in which position the lever 1' abuts against a step 8 formed on an edge defining an opening in the cover *a*.

The lever 1 is connected, on one of its sides, to the feed mechanism *b*, for the tape 5. The mechanism *b* includes an arm 9 which is pivotally connected at 10 to the lever 1. The arm 9 has a rear appendage that abuts against a projection 11 projecting from the surface of the lever 1.

The operating terminal portion of the arm 9 has a guiding element 12, on one side thereof, that is displaceable in a track that forms a closed circuit with an initial section 13, having an ascending surface, that ends in a lower step from which a rectilinear section 14 continues, the section 14 being continuous with curvilinear portion 15 of a return section of the closed circuit track for the guide element 12. The portion 15 has an ascending portion that, in its final portion, where it meets the beginning of the initial section 13, defines a lower step 16.

On the opposite side from the guiding element 12, the end of the arm 9 has a toothed portion 17 that, when the guiding element 12 runs along the ascending initial run 13 of the track, the arm rises and the toothed portion 17, meshes with the sprocket 18, which as a sector passing through an opening 19, in the cover *a*, above the path of travel of the tape 5, the tape 5 being pressed against the sprocket 18 by a substantially elastic element 20.

Figure 5:
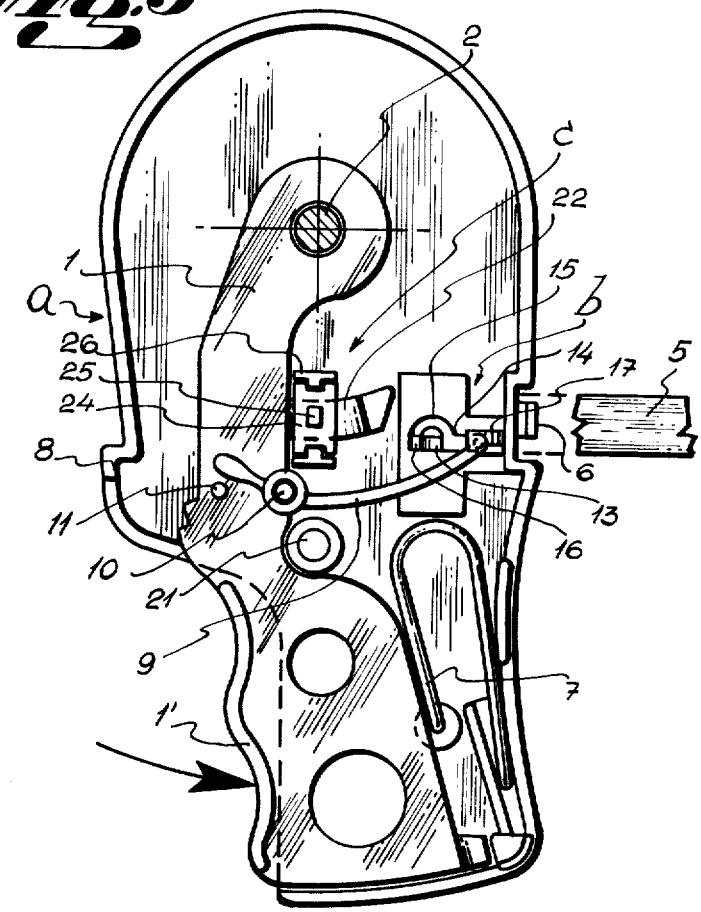
FIG. 5 is a plan view showing the final operative stage of the angular displacement of the lever wherein the driving means of the sprocket is displaced independently while the type member on the hammer completes the displacement thereof to the final printing position.

In the central portion of the surface of the cover *a*, there is an upright rod 21 that acts as a butt stop for the angular displacement of the lever 1 at the end of its operating run, as is illustrated in FIG. 5, wherein the guiding element 12 of the arm 9 finishes its movement in the rectilinear end 14 of the closed circuit track in which the guiding element is moved.

Besides the system of printing wheels 3 and 4, of the known type, between which the tape 5 passes, the printing mechanism *c*, includes a curved arm 22, projecting from the lever 1 and is unitary therewith. The projecting portion has a sloped internal form in the shape of a wedge, displaceably arranged in a transverse opening 23, defined by upper and lower portions having sloped, runs which are parallel to each other. A unitary upper portion 24 of the arm 22 forms a punch 25, correspondingly arranged with the path of the tape 5 and beneath the type carrying ends of the elastic arms of the lower wheel 4.

The portion 24 of the arm 22 constitutes a printing hammer and is displaceably guided in a direction substantially normal of the pivoting displacement of the lever 1, by up and down motion on fixed guide supports 26 on the opposite sides thereof.

The operation of the labeling device is believed to be apparent from the foregoing description and drawings. In the resting, inoperative position, illustrated in FIGS. 1 and 2, the lever 1 is biased by the spring 7, to a position of maximum angular displacement toward the outer part of the cover *a*, abutting against the edge stop 8. In this position, the arm member 22 of the printing mechanism *c* has its end portion inoperatively inserted in the sloped opening 23 of the element 24 that forms the hammer. The hammer 24 remains in its lowered position on the guides 26. The guiding element 12 of the arm 9, corresponding to the feed mechanism *b*, is placed in the initial rest position at the beginning of the inclined run 13 of the closed track therefor.

Figure 3:
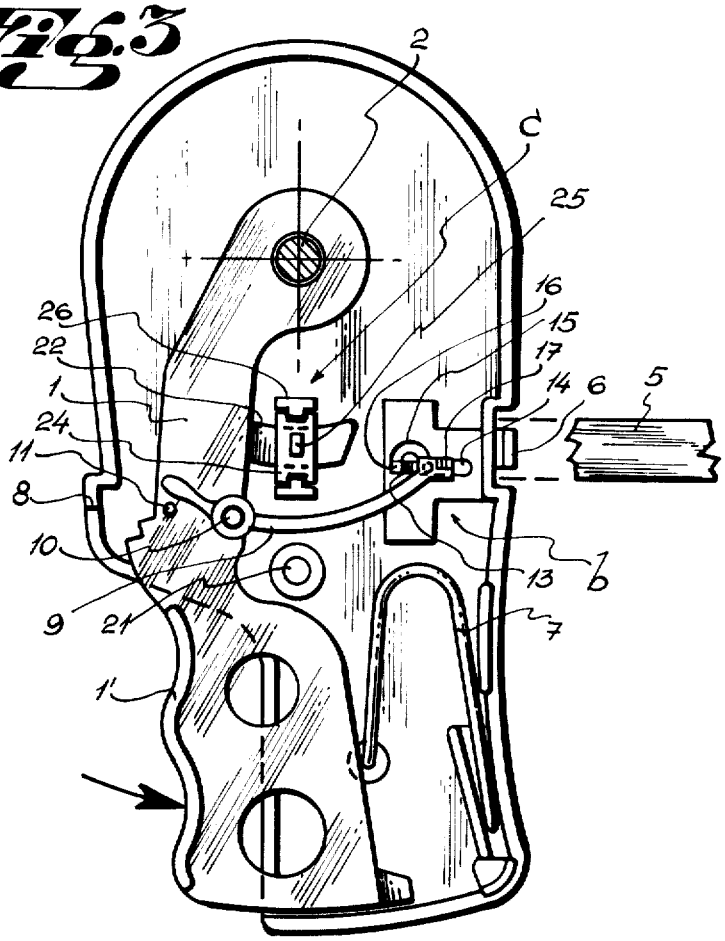
FIG. 3 is a plan view, similar to that of FIG. 1, illustrating the initial stages wherein the pulsator lever is angularly displaced in its first run, corresponding to the advance of the tape to the printing position.
Figure 4:
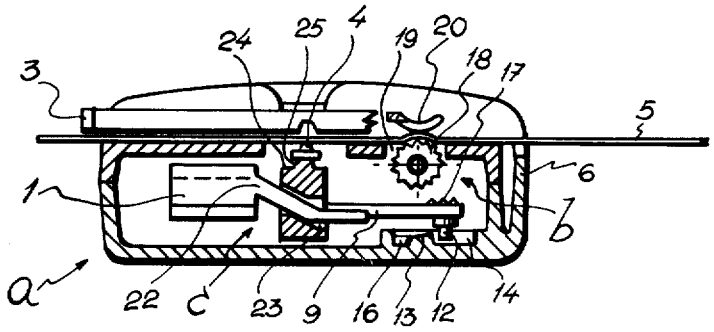
FIG. 4 is a cross sectional view, corresponding to the position illustrated in FIG. 3, showing how the driving member has already descended from its gearing position on the tape feeding sprocket at the same time that the printing hammer has initiated the printing movement without pressing the tape with the end of the elastically deformable arm of the lower printing wheel.

When the lever 1 is angularly displaced, by moving the outer portion 1', as seen in FIGS. 3 and 4, the member 9 is displaced with the lever portion 1' and the guiding element 12 moves along the ascending run 13 of the span. In the ascending section, the terminal portion of the arm member 9 rises and its upper toothed portion 17 meshes with the wheel 18, against which the tape 5 is pressed by the biasing element 20, thereby angularly displacing the wheel 18 in a predetermined angle, the displacement linearly moving a predetermined length of tape toward the printing section of the mechanism.

The tape displacement ends when the guiding element 12 of the arm 9 reaches the end of the inclined section 13 of the span, and descends so as to cause the toothed portion 17 to disengage from the wheel 18.

Figure 6:
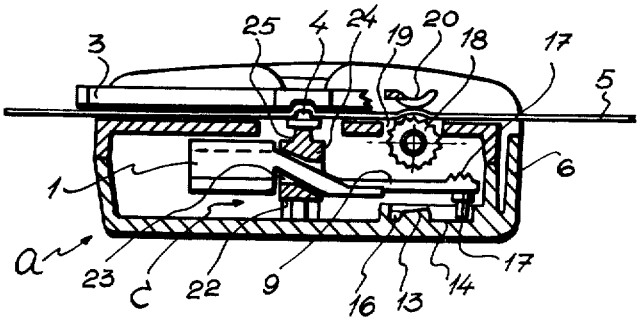
FIG. 6 is a transverse sectional view showing the deformation of the tape, between both wheels, with the type to be printed, in response to the thrust of the hammer that responds to the unitary portion of the lever.

In this stage of the operation, the arm member 22 for operating the printing mechanism *c*, operating with its sloped portion in the opening 23 of the element 24, slightly lifts the hammer element 24 without causing its upper portion 25 to reach the printing position. As, the member 22 of the lever 1 continues to be pressed (FIGS. 5 and 6), the guiding element 12 of the arm 9 continues its movement in the curved section 14 of the track therefor while the feed mechanism for the tape is inoperative, the sprocket 18 being locked because the compression elastic element 20 bears against the tape 5 and the wheel 18 acts as a brake. In the continued lever displacement, the member 22 continues lifting the element 24 and the upper projection 25 thereof thrusts the elastic arm of the wheel 4 toward the printing position of the tape 5 and against the upper wheel 3, as is shown in FIG. 6, thereby ending the operative cycle.

On releasing the lever 1, the return spring 7, which has been stretched to its limit position by the butt 21, causes the lever to return to its initial position. In the first section of the return, the guide element 12 travels back along the curved section 14 of the track, finds the terminal step defined by the section 13 and is deflected by the curved lateral portion 15. The later track portion may be slightly ascending, as the upper toothed portion 17 of the terminal end of the arm 9 is not positioned to mesh with the tape advance wheel 18. At the end of the final return, the section 15 of the guiding element 12 descends to its initial position. The step 16, formed in the end of the return section 15, has the object of preventing, on initiating the operative run, through the action of the lever 1, the guiding element 12 from being deflected thereby, instead of ascending through the initial section 13. In this condition, the assembly is in a position to effect a new cycle of operation.

If it is only desired to make the tape advance, that is to say, to space same without printing, it is sufficient to carry the lever 1 to the position illustrated in FIGS. 3 and 4, that is, the guiding element, 2 does not move along the final section 14 of the closed track. Having thus advanced the tape 5 in the first stage, by releasing the lever 1, the spring 7 returns the lever 1 back again with the guiding element 12 traveling through the return curved section 15 of the closed circuit span.

In this manner an improved operating efficiency is obtained, as the feed mechanism *b* operates directly on the tape feeding sprocket 18, without rollers or other intermediate elements. Likewise, accessory locking means are eliminated in order to lock the wheel 18 during the printing operation, as the same elastic element 20 that presses the tape 5 in order to obtain dragging without slipping, has a braking effect on the tape when the feeding stage has ended.

The step 16 formed at the end of the return path through the run 15 of the track to the initial inoperative position may be discarded if the rear support 11 of the arm 9 tends to maintain the arm 9 directed, with its guiding end 12, toward the ascending initial section 13 of the span, which would thus prevent the arm beginning the stroke through the return section 15. In a similar manner, this condition could be obtained through an adequate elastic thrust means operating on the arm 9.

While in the foregoing there has been provided a detailed description of one embodiment of the present invention, it is to be understood that all equivalents obvious to those having skill in the art are to be included within the scope of the invention, as claimed.

What I claim and desire to secure by Letters Patent is:

1. In a labeling device of the type that includes a body, a pair of rotatable spaced wheels on said body, a path of travel defined between said wheels and in a first plane through which tape to be imprinted is passed, means for feeding said tape along said path of travel, one of said wheels including elastically deformable arms movable in a direction transverse to said tape, each of said arms carrying a printing element, the other of said wheels including corresponding printing elements, each printing element on each arm cooperating with one of said corresponding printing elements on said other wheel for imprinting a desired character on said tape upon said transverse movement of one of said arms, means for applying pressure to said deformable arms for causing transverse movement thereof for imprinting characters on said tape, a lever pivotally mounted on said body for movement about a first axis for operating said tape feeding means and said pressure applying means, said first axis being transverse to said first plane, and biasing means for pivotally returning said lever to an inoperative position, the improvement comprising, in combination, an arm member pivotally mounted on said lever about a second axis laterally spaced from said first axis, said arm member extending laterally outwardly of said lever, a free end portion being defined on said arm member and having a guide element thereon, said arm being movable in a direction transverse to said first plane, a closed track defined in said body having an initial portion, a latter portion, and a return portion which connects with said initial portion, said track being constructed and arranged to guidably receive said guide element therein both for movement about said second axis and for said transverse movement, said tape feeding means including a sprocket wheel rotatably carried by said body and being constructed and arranged to drivably engage and move said tape in said path of travel, means carried on said end portion of said arm member for drivably engaging and rotating said sprocket wheel for moving said tape as said guide element is moved in said initial portion only of said track in response to pivoting movement about said first axis, said pressure applying means being guidably and movably carried on said lever for movement towards and away from said one printing element on one of said arms for imprinting a desired character on said tape as the guide element is moved in said latter portion only of said track in response to continued pivoting compression of said lever, said guide element moving in said return portion upon movement of said lever to the inoperative position by said biasing means.

2. In a labeling device of the type that includes a body, a pair of rotatable spaced wheels on said body, a path of travel defined between said wheels and in a first plane through which tape to be imprinted is passed, means for feeding said tape along said path of travel, one of said wheels including elastically deformable arms movable in a direction transverse to said tape, each of said arms carrying a printing element, the other of said wheels including corresponding printing elements, each printing element on each arm cooperating with one of said corresponding printing elements on said other wheel for imprinting a desired character on said tape upon said transverse movement of one of said arms, means for applying pressure to said deformable arms for causing transverse movement thereof for imprinting characters on said tape, a lever pivotally mounted on said body for movement about a first axis for operating said tape feeding means and said pressure applying means, said first axis being transverse to said first plane, and biasing means for pivotally returning said lever to an inoperative position, the improvement comprising, in combination, an arm member pivotally mounted on said lever about a second axis laterally spaced from said first axis, said arm member extending laterally outwardly of said lever, a free end portion being defined on said arm member and having a guide element thereon, said arm being movable in a direction transverse to said first plane, a closed track defined in said body having an upwardly inclined initial portion, a latter portion, and a return portion following said latter portion for directing the guide element back to a starting position, said track being constructed and arranged to guidably receive said guide element therein both for movement about said second axis and for said transverse movement, said tape feeding means including a sprocket wheel rotatably carried by said body and being constructed and arranged to drivably engage and move said tape in said path of travel, means carried on said end portion of said arm member above said guide element for drivably engaging and rotating said sprocket wheel for moving said tape as said guide element is moved up said incline in said initial portion only of said track in response to pivoting movement by only compressing said lever for pivoting movement about said first axis, said guide element moving out of engagement with said track in said latter track portion, said pressure applying means being guidably and movably carried on said lever for movement towards and away from said one printing element on one of said arms for imprinting a desired character on said tape as guide element is moved in said latter portion only of said track in response to continued pivoting compression of said lever.

* * * * *